US005310719A

United States Patent [19]

Wehrmann et al.

[11] Patent Number: 5,310,719

[45] Date of Patent: May 10, 1994

[54] DYE ACCEPTOR ELEMENT FOR THERMOSUBLIMATION PRINTING

[75] Inventors: Rolf Wehrmann, Krefeld; Geert Defieuw, Kessel-Lo, both of Fed. Rep. of Germany; Emil Verdonck, Berlaar; Herman Uytterhoeven, Bonheiden, both of Belgium; Rolf Dheim, Krefeld; Walter Schafer, Leichlingen, both of Fed. Rep. of Germany

[73] Assignee: AGFA-Gevaert AG, Leverkusen

[21] Appl. No.: 849,948

[22] Filed: Mar. 12, 1992

[30] Foreign Application Priority Data

Mar. 15, 1991 [DE] Fed. Rep. of Germany ..... 4108450

[51] Int. Cl.[5] ..... B41M 5/035; B41M 5/38

[52] U.S. Cl. ..... 503/227; 428/195; 428/423.1; 428/913; 428/914

[58] Field of Search ..... 8/471; 428/195, 423.1, 428/913, 914; 503/227

[56] References Cited

FOREIGN PATENT DOCUMENTS 0234563 of 0000 European Pat. Off. ..... 503/227
0359532 3/1990 European Pat. Off. ..... 428/204
0394460 10/1990 European Pat. Off. ..... 503/227

*Primary Examiner*—B. Hamilton Hess
*Attorney, Agent, or Firm*—Connolly & Hutz

[57] ABSTRACT

Dye transfers of high color density, excellent sharpness and good stability are obtained in thermosublimation printing using a dye acceptor layer consisting essentially of a polyurethane formed by crosslinking and characterized in that the polyurethane contains at least 5% by weight urethane groups (—O—CO—NH—).

6 Claims, No Drawings

DYE ACCEPTOR ELEMENT FOR THERMOSUBLIMATION PRINTING

This invention relates to a dye acceptor element for thermosublimation printing.

Printouts of video- or computer-stored images can be made by a number of methods among which thermosublimation printing has proved to be superior for certain requirements by virtue of its advantages over other processes. In this recording method, a sheet-form or web-form donor material containing a sublimatable dye is brought into contact with a dye acceptor layer and is heated imagewise to transfer the dye.

The thermohead is controlled and the dye transferred from the donor material to the acceptor element in accordance with the stored original. A detailed description of the process can be found, for example, in "High Quality Image Recording by Sublimation Transfer Recording Material", Electronic Photography Assocation Documents 27 (2), 1988 and in the literature cited therein. A particular advantage of this printing process is that it enables color intensities to be finely graduated.

Dye acceptor elements for thermosublimation printing usually comprise a support, for example paper or transparent films, which is coated with the actual dye acceptor layer. A binder layer can be arranged between the support and the acceptor layer.

Polymers of different classes may be used as the material for the dye acceptor layer.

Dye acceptor layers containing urethane groups are also known (EP-A-0 234 563). In this case, however, the urethanes are described only as a possible constituent which is generally combined with other thermoplastic polymers.

Crosslinked dye acceptor layers based on polyhydroxyl compounds and polyisocyanates (EP-A-0 394 460) have also been described, although in this case the percentage of crosslinking urethane groups is low. Accordingly, the color densities achieved are not very high.

The dye acceptor layers available at the present time are not yet entirely satisfactory in regard to high color density, adequate image stability and good resolution. It is particularly difficult in this regard to achieve high color density and adequate image stability for minimal lateral diffusion.

The problem addressed by the present invention was to provide a dye acceptor element for thermosublimation printing which would not have any of the disadvantages mentioned above.

It has been found that highly crosslinked polyurethane coatings substantially inert to chemical influences are suitable for absorbing the dye in thermodiffusion printing, the prints thus formed being distinguished by excellent image quality, such as sharpness, image stability and color density. In addition, the coatings themselves have little or no tendency towards adhesion.

The present invention relates to a dye acceptor element for thermosublimation printing comprising a dye acceptor layer consisting essentially of a polyurethane formed by crosslinking, wherein the polyurethan has been formed by crosslinking with a polyisocyanate from a polymer that contains hydroxyl groups, said polymer beeing selected from the group consisting of a) polyethers b) polyesters c) polymers containing polymerized acrylate monomers, and d) polymers containing polymerized monomers selected from the group consisting of vinyl acetate, vinyl butyral, maleic acid, dibutyl maleate, crotonic acid, vinyl laurate, acrylonitrile and ethylene and the polyurethane contains at least 4 % by weight urethane groups (—O—CO—NH—).

In the production of polyurethanes, urethane groups are generally formed by reaction between hydroxyl groups and isocyanate groups. Accordingly, the polyurethanes according to the invention are formed by reaction of polymers containing at least two hydroxyl groups polymeric (polyols) with compounds containing at least two isocyanate groups (polyisocyanates). At least one of the two reaction components (polymeric polyol, polyisocyanate) is completely or (in the case of mixtures partly trifunctional or higher, which means that at least one polyol containing three or more hydroxyl groups and/or at least one polyisocyanate containing three or more isocyanate groups must be present in the reaction mixture.

The polymeric polyols may be, for example, polyesters, polyethers or polyvinyl compounds or may even be polymers or prepolymers already containing urethane groups.

The polyols preferably used are polyhydroxypolyesters having an average molecular weight ($\overline{M}_n$) of 250 to 3,000, for example based on dihydric and, optionally, trihydric or higher alcohols with polybasic, preferably dibasic, carboxylic acids (polycarboxylic acids). Instead of the free polycarboxylic acids, the corresponding polycarboxylic anhydrides or corresponding polycarboxylic acid esters of lower alcohols or mixtures thereof may be used for the production of the polyesters. The polycarboxylic acids may be aliphatic, cycloaliphatic, aromatic and/or heterocyclic and may optionally be substituted, for example by halogen atoms, and/or unsaturated. Examples of such polycarboxylic acids are succinic acid, adipic acid, azelaic acid, sebacic acid, phthalic acid, isophthalic acid, trimellitic acid, phthalic anhydride, tetrahydrophthalic anhydride, hexahydrophthalic anhydride, endomethylene tetrahydrophthalic anhydride, glutaric anhydride, maleic acid, maleic anhydride, fumaric acid, terephthalic acid dimethyl ester and terephthalic acid bis-glycol ester. Suitable polyhydric alcohols are, for example, ethylene glycol, 1,2- and 1,3propylene glycol, 1,4- and 2,3-butylene glycol, hexane-1,6diol, octane-1,8-diol, neopentyl glycol, cyclohexane dimethanol (1,4-bis-hydroxymethylcyclohexane), 2-methylpropane-1,3-diol, glycerol, trimethylol propane, hexane-1,2,6-triol, butane-1,2,4-triol, trimethylol ethane, pentaerythritol, quinitol, mannitol and sorbitol, methyl glycoside, also diethylene glycol, triethylene glycol, tetraethylene glycol, polyethylene glycols, dipropylene glycol, polypropylene glycols, dibutylene glycol and polybutylene glycols. Polyesters of lactones, for example $\epsilon$-caprolactone, or hydroxycarboxylic acids, for example $\omega$-hydroxycaproic acid, may also be used. Other suitable polyesters are described, for example, in Karsten "Lackrohstoff-Tabellen", 8th Edition, 1987

Preferred hydroxyl-functional polyvinyl compounds are those having an average molecular weight ($\overline{M}_n$) in the range from 1,000 to 150,000; the following are preferred:

1. Polyacrylates having a hydroxyl group content of 1 to 10% by weight. These compounds are produced in known manner by copolymerization of olefinically unsaturated monomers using hydroxyl-functional olefinically unsaturated monomers. Suitable monomers are, for example, alkyl acrylates and/or methacrylates containing 1 to 6 carbon atoms in the alkyl radical, such as for example methyl acrylate, methyl methacrylate, ethyl acrylate, ethyl methacrylate, n-butyl acrylate or nhexyl methacrylate and/or styrene. Suitable hydroxyfunctional monomers are, for example, hydroxyalkyl esters of acrylic or methacrylic acid containing 2 to 6 carbon atoms in the hydroxyalkyl radical, such as for example hydroxyethyl, 2-hydroxypropyl, 3-hydroxypropyl, 4-hydroxybutyl or 6-hydroxyhexyl acrylate or methacrylate. Other suitable products are described, for example, in Karsten "Lackrohstoff-Tabellen", 8th Edition.

2. Polymers having a hydroxyl group content of 1 to 10% by weight. These compounds are produced in known manner by copolymerization of olefinically unsaturated monomers using olefinically unsaturated monomers suitable for the subsequent release of hydroxyl groups. Suitable monomers are, for example, vinyl acetate, vinyl butyral, maleic acid, maleic acid di-n-butyl ester, crotonic acid, vinyl laurate, acrylonitrile and ethylene. The hydroxyl groups are obtained, for example, by partial saponification of acetate groups or by copolymerization with hydroxyl-functional vinyl compounds, for example of the type mentioned under 1. An example of suitable hydroxyl-functional copolymers is polyvinyl butyryl.

These and other products of this type are commercially available and are described, for example, in Karsten "Lackrohstoff-Tabellen", 8th Edition.

The following are examples of polyisocyanate compounds which may be used as starting materials in the production of the dye acceptor layer of the dye acceptor element according to the invention:

(i) Simple organic polyisocyanates having a molecular weight in the range from 168 to 300, such as for example 1,6-diisocyanatohexane, 1-isocyanato-3,3,5-trimethyl-5-isocyanatomethyl cyclohexane, 2,4- and/or 2,6-diisocyanatotoluene, 4,4'- and/or 2,4'-diisocyanatodiphenyl methane or 4,4'-diisocyanatodicyclohexyl methane. However, these simple diisocyanates are not preferred.

(ii) Modified "lacquer polyisocyanates" having an average molecular weight of up to 1,000, i.e. modified polyisocyanates known per se containing urethane, biuret, isocyanurate, uretidinecione, uretone imine or oxadiazine groups and based on the simple diisocyanates mentioned under (i), such as for example tris-(6-isocyanatohexyl)-biuret or mixtures thereof with its higher homologs or tris-(6-isocyanatohexyl)-isocyanurate or mixtures thereof with its higher homologs and optionally, with bis-(6-isocyanatohexyl)-uretidinedione bis-(6-isocyanatohexyl)-oxadiazine trione.

Starting polyisocyanates containing aliphatically bound isocyanate groups are preferably used in the process according to the invention. Aliphatic lacquer polyisocyanates of the type mentioned by way of example under (ii) are particularly preferred starting materials, optionally in admixture with aromatic polyisocyanates.

Basically, polyisocyanate compounds containing incorporated carboxylate groups may also be used.

This would be possible, for example, by reacting hydroxycarboxylic acids, such as dimethylol propionic acid for example, with the corresponding quantities of isocyanate.

Polyols and polyisocyanates together form a reactive mixture for producting the key constituent or principal constituent of the dye acceptor layer according to the invention. The polyols and polyisocyanates are so selected and are used in such a mixing ratio that a cross-linked, no longer soluble polyurethane containing at least 4% by weight, preferably 5 to 20% by weight and more preferably 6 to 12% by weight urethane groups (—O—CO—NH—) is formed during the curing process. A considerable proportion of these urethane groups is newly formed during the reaction of the polyols with the polyisocyanates, although more of the urethane groups may have already been present in the polyol component and/or the polyisocyanate component. The ratio of isocyanate groups to hydroxyl groups before crosslinking is between 0.6:1 and 1.5:1 and preferably of the order of 1:1.

The starting products for the production of the polyurethanes according to the invention may also be used in the form of mixtures with other known, preferably nonreactive resins for dye acceptor layers. For example, the following polymers a) to e) - either individually or in admixture - may be used in combination with the polyols and polyisocyanates:

a) polymers containing ester bonds: polyesters, polyacrylates, polycarbonates, polyvinyl acetate, polyvinyl propionate, styrene acrylates, methyl styrene acrylates, etc.

b) polymers containing urethane bonds: polyurethanes, polyester urethanes, etc.

c) polymers containing amide bonds: polyamides, polyester amides, etc.

d) polymers containing urea bonds: polyureas, etc.

e) polymers containing other highly polar bonds, such as for example polystyrenes, polyvinyl alcohol, polyvinyl chloride, polyacrylonitrile, polyethers, polysulfones, polyether ketones, polyhydantoin, polyimides, styrene/MA copolymers, cellulose derivatives, etc.

Examples of such resins can be found, for example, in EP-A-0 227 094, EP-A-0 228 066, EP-A-0 133 011, EP-A-0 133 012 or EP-A-0 144 247.

In cases where the starting products for the production of the polyurethanes according to the invention are used in combination with other resins of the type mentioned above as the dye acceptor layer, the percentage content of the other resins in the mixture as a whole is between 0 and 50% by weight.

High-boiling solvents or plasticizers may also be added to the dye acceptor layer and may provide, for example, for better solubility of the transferred dyes. Useful representatives of these compounds are mentioned, for example, in JP 62/174 754, JP 62/245 253, JP 61/209 444, JP 61/200 538, JP 62/136 646, JP 62/30 274.

Pigments or mixtures of several pigments, such as for example titanium dioxide, zinc oxide, kaolin, clay, calcium carbonate or Aerosil, may be added to the dye acceptor layer, for example to increase image sharpness or to improve whiteness.

If necessary, various types of additives, including for example UV absorbers, light stabilizers or antioxidants, may be added in order further to increase the light stability of the transferred dye.

The dye acceptor layers according to the present invention may contain a lubricant to improve the abhesive properties, primarily between the donor element and the acceptor element. For example, solid waxes, such as polyethylene wax, amide waxes or Teflon powder may be used for this purpose, although fluorine-containing surfactants, paraffin oils, silicone oils or fluorine-containing oils or silicone-containing copolymers, such as polysiloxane/polyether copolymers, may also be used as lubricants.

The lubricant mentioned may even be applied as a separate coating, for example in the form of a dispersion or a solution in a suitable solvent (top coat). The thickness of such a layer is preferably from 0.01 to 5 μm and more preferably from 0.05 to 2 μm.

One particular advantage of the dye acceptor element according to the invention is that the polyurethane used in the dye acceptor layer has an extremely low tendency towards adhesion by virtue of the comparatively high content of urethane groups and the resulting high degree of crosslinking. Accordingly, there may even be no need to use a lubricant —whether in added form or as a separate coating —to prevent the layers from adhering to one another during dye transfer. This is advantageous above all because a reduction in the color density, sharpness and stability of the dye image transferred is often observed where a lubricant is used.

Various materials may be used as supports for the dye acceptor layers. It is possible to use transparent films, such as for example polyethylene terephthalate, polycarbonate, polyether sulfone, polyolefin, polyvinyl chloride, polystyrene, cellulose or polyvinyl alcohol copolymer films. Reflective supports, such as the various types of papers, for example polyolefin-coated paper or pigmented papers, may of course also be used. Laminates of the materials mentioned above are also suitable supports. Typical combinations are laminates of cellulose paper and synthetic paper or cellulose paper and polymer films or polymer films and synthetic paper or even other combinations.

The supports provide for the necessary mechanical stability of the dye acceptor element. If the dye acceptor layer has sufficient mechanical stability, there may be no need for an additional support.

The dye acceptor layers according to the present invention preferably have overall layer thicknesses of 0.3 to 50 μm and, more preferably, 0.5 to 10 μm where a support of the type described above is used or —in the absence of such a support —3 to 120 μm. The dye acceptor layer may consist of a single layer although two or more layers may also be applied to the support. Where transparent supports are used, they may be coated on both sides to increase color intensity, as described for example in European patent application 90 200 930.7.

The dye acceptor element according to the present invention may also contain various interlayers between the support and the dye receptor layer. Depending on the specific properties of the material used, the interlayer may act as an elastic layer, as a barrier layer for the dye transferred or even as a binder layer, depending on the particular application. Suitable materials are, for example, urethane, acrylate or olefin resins and also butadiene rubbers or epoxides. The thickness of this interlayer is normally between about 1-2 and 20 μm. The function of the diffusion barrier layers is to prevent the transferred dyes from diffusing into the support. Materials which perform this function may be soluble in water or in organic solvents or in mixtures, but preferably in water. Suitable materials are, for example, gelatine, polyacrylic acid, maleic anhydride copolymers, polyvinyl alcohol or cellulose acetate.

The additional layers optionally present, such as the elastic layer, the diffusion barrier layer, the binder layer, etc., and the actual dye acceptor layer may contain, for example, silicate, clay, aluminium silicate, calcium carbonate, calcium sulfate, barium sulfate, titanium dioxide or aluminium oxide powder.

The dye acceptor element according to the invention may also be antistatically treated in the usual way on its front or back. In addition, it may be provided with markings, for example on the back of the support, in order to achieve exact positioning during the printing process.

The dye acceptor element according to the invention may be combined with any of the dye donor elements typically used in thermosublimation printing.

The dye images obtained in a thermosublimation printer are distinguished by high resolution, high color densities, high brilliance and good long-term stability.

The mixture from which the dye acceptor layers according to the invention is produced is normally processed from solution. Suitable solvents are, for example, methyl ethyl ketone, toluene, xylene, butyl acetate, methylene chloride, chlorobenzene, tetrahydrofuran or dioxane. The solution may be applied by casting or knife coating or by printing onto the support. The coating is then heated to remove the solvent and to initiate crosslinking of the polyols and polyisocyanates to form the crosslinked polyurethane. The heating conditions are governed by the particular circumstances of each individual case, for example by the type of support and solvent used, the layer thickness and the reactivity of the reactive components used.

EXAMPLES

The formulations listed in Table 1 were used for the production of dye acceptor layers. The stoichiometry was selected so that the same equivalents of isocyanate and hydroxyl groups were present. The particular form in which the starting compounds were supplied was diluted with methyl ethyl ketone to such an extent that 25% solutions, including 0.25% zinc(II) octoate (Desmorapid ® SO), could be knife-coated in a wet film thickness of 5 μm onto a paper which was coated on both sides with polyethylene and to one side of which a gelatine layer was additionally applied over the polyethylene. The coating was applied to that side. The coatings were dried for 30 minutes at 70.C in a recirculating air drying cabinet. These samples are denoted by the letter A in the Table. A 0.5% solution in ethanol of Tego Glide 410 (Goldschmidt) was then applied in a wet film thickness of 24 μm and dried at 70° C. in a recirculating air drying cabinet. These samples are denoted by the letter B in the Table. Test images were produced on the dye receptor elements obtained with a Mitsubishi CP-100 E video printer using a Mitsubishi CK-100 S dye cassette.

The dye acceptor layers produced from the crosslinked systems according to the invention are distinguished by increased color densities and a greatly reduced tendency towards adhesion of the prints. They also have high sharpness after heating.

The following prepolymers were used in the samples described in Table:

a) Polyisocyanates (column "P-iso")

1. Desmodur ® 3390
aliphatic polyisocyanate
NCO content: approx. 19.4%
2. Desmodur ® 2550
low-viscosity aliphatic polyisocyanate
NCO content: approx. 22%
3. Desmodur ® 4370
polyfunctional aliphatic polyisocyanate
NCO content: approx. 11.5%
4. Desmodur ® W
4,4'-diisocyanatodicyclohexyl methane
5. Desmodur ® H
hexamethylene diisocyanate
6. Desmodur ® HL
aromatic-aliphatic polyisocyanate
NCO content: approx. 10.5%
Desmodur ® is a registered trademark of Bayer AG, Leverkusen.

b) Polyols (column "P-ol")
1. Desmophen ® A 265
hydroxyl-functional polyacrylate
OH content: approx. 2.2%
2. Desmophen ® 680
hydroxyl-functional polyester containing branched, weakly unsaturated C : fatty acids
OH content: approx. 2.0%
3. Crelan ® U 502
hydroxyl-functional, oil-free saturated polyester based on terephthalic acid
OH content: approx. 1.5%
4. Desmophen ® A 160
hydroxyl-functional polyacrylate
OH content: approx. 1.6%
5. Desmophen ® 670
weakly branched hydroxyl-functional polyester
OH content: approx. 4.3%
6. Desmophen ® 900 U
hydroxyl-functional branched polyether
OH content: approx. 8.8 %
7. Desmophen A 365
hydroxyl-functional polyacrylate
OH content: approx. 2.8 %

Desmophen ® and Crelan ® are registered trademarks of Bayer AG, Leverkusen.

TABLE

| Sample | Composition P-iso | Composition P-ol | Color density Yellow | Color density Magenta | Color density Cyan | Sharpness[1]* | Adhesion[2]* |
|---|---|---|---|---|---|---|---|
| 1 A | 3 | 1 | 1.45 | 1.60 | 1.71 | ++ | + |
| 2 A | 3 | 2 | 1.45 | 1.56 | 1.64 | ++ | + |
| 3 A | 3 | 3 | 1.68 | 1.74 | 1.78 | ++ | + |
| 4 B | 3 | 3 | 1.61 | 1.69 | 1.66 | + | + |
| 5 B | 3 | 5 | 1.72 | 1.81 | 1.90 | ++ | + |
| 6 A | 2 | 1 | 1.63 | 1.77 | 1.80 | ++ | + |
| 7 A | 2 | 2 | 1.63 | 1.80 | 1.86 | ++ | + |
| 8 B | 2 | 2 | 1.58 | 1.54 | 1.76 | + | + |
| 9 B | 2 | 3 | 1.61 | 1.77 | 1.75 | ++ | + |
| 10 A | 2 | 4 | 1.57 | 1.79 | 1.81 | ++ | + |
| 11 B | 5 | 3 | 1.61 | 1.69 | 1.49 | ++ | +− |
| 12 A | 1 | 3 | — | — | — | ++ | + |
| 13 B | 6 | 2 | 1.70 | 1.90 | 1.90 | ++ | + |

[1]*Sharpness after heating for 72 h at 57° C.
++ very sharp
+ sharp
+− slightly unsharp
−unsharp
[2]*Adhesion
+ no adhesion
+− slight adhesion
− significant adhesion The examples accompanied by the letter "A" do not contain any lubricant.

The examples accompanied by the letter "B" additionally contain a separate layer of lubricant.

In the same way as described above further dye acceptor elements according to the present invention have been prepared. The compositions used and the results obtained are shown in the following table 2.

TABLE 2

| Sample | Composition P-iso | Composition P-ol | [3]*color density | [1]*sharpness | [2]*Adhesion |
|---|---|---|---|---|---|
| 14 A | 3 | 6 | ++ | + | + |
| 15 A | 1 | 6 | + | + | + |
| 16 A | 1 | 1 | ++ | ++ | + |
| 17 A | 4 | 1 | ++ | ++ | + |
| 18 A | 5 | 1 | ++ | ++ | + |
| 19 A | 2 | 1 | + | + | + |
| 20 A | 3 | 1 | + | ++ | + |
| 21 A | 4 | 7 | + | ++ | + |
| 22 A | 5 | 7 | ++ | ++ | + |
| 23 A | 2 | 7 | ++ | ++ | + |

[3]*color density
++ very good
+ good

Further samples 24 and 25 were prepared by coating the compositions of samples 18 and 23 on a transparent PET foil having a thickness of 175 μm (instead of the polyethylene-coated paper). The same results have been obtained as described in table 2.

We claim:

1. A thermosublimation printing dye acceptor element in combination with a sheet-form or web-form donor material containing a sublimatable dye, said dye acceptor element comprising a support and, coated thereon, a dye acceptor layer consisting essentially of a polyurethane formed by crosslinking, wherein the polyurethane has been formed from a polymer that contains hydroxyl groups by crosslinking said polymer with a polyisocyanate, said polymer being selected from the group consisting of a) polyethers;
b) polyesters;
c) polymers containing polymerized acrylate monomers; and
d) polymers containing polymerized monomers selected from the group consisting of vinyl acetate, vinyl butyral, maleic acid, dibutyl maleate, crotonic acid, vinyl laurate, acrylonitrile and ethylene, and the polyurethane contains at least 4% by weight urethane groups (—O—CO—NH—).

2. A dye acceptor element as claimed in claim 1, wherein the polyurethane contains 5 to 20% by weight urethane groups.

3. A dye acceptor element as claimed in claim 1 wherein the polyurethane is formed from a polyol component optionally containing urethane groups by crosslinking the polyol component with a polyisocyanate component optionally containing urethane groups.

4. A dye acceptor element as claimed in claim 3, wherein at least one polyol of the polyol component contains 3 or more hydroxyl groups and/or at least one polyisocyanate of the polyisocyanate component contains three or more isocyanate groups.

5. A dye acceptor element as claimed in claim 3, wherein the polyisocyanate component consists of one or more polyisocyanates optionally containing urethane, biuret, isocyanurate, uretidinediones, uretone imine or oxadiazine trione groups.

6. A dye acceptor element as claimed in claim 1, wherein said dye acceptor element does not contain any lubricant.

* * * * *

UNITED STATES PATENT AND TRADEMARK OFFICE

CERTIFICATE OF CORRECTION

PATENT NO. : 5,310,719

DATED : May 10, 1994

INVENTOR(S) : Wehrmann, et al

It is certified that error appears in the above-indentified patent and that said Letters Patent is hereby corrected as shown below:

On the title page, item [75] Inventor: "Rolf Dheim" should be --Rolf Dhein--.

Signed and Sealed this

Fourth Day of February, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,310,719

DATED : May 10, 1994

INVENTOR(S) : Wehrmann et al.

It is certified that error appears in the above-indentified patent and that said Letters Patent is hereby corrected as shown below:

On the title page, item [75], the country of residence for Geert Defieuw is "Belgium" and not "Fed. Rep. of Germany".

Signed and Sealed this

Sixth Day of May, 1997

*Attest:*

*Attesting Officer*

BRUCE LEHMAN

*Commissioner of Patents and Trademarks*